US009119767B2

(12) United States Patent
Wood

(10) Patent No.: US 9,119,767 B2
(45) Date of Patent: Sep. 1, 2015

(54) MANUAL CPR OR CCC CONTINUOUS CHEST COMPRESSION ASSIST DEVICE

(76) Inventor: Harrill D. Wood, Talking Rock, GA (US)

( * ) Notice: Subject to any disclaimer, the term of this patent is extended or adjusted under 35 U.S.C. 154(b) by 621 days.

(21) Appl. No.: 13/473,155

(22) Filed: May 16, 2012

(65) Prior Publication Data

US 2013/0066242 A1 Mar. 14, 2013

Related U.S. Application Data

(60) Provisional application No. 61/533,901, filed on Sep. 13, 2011.

(51) Int. Cl.
*A61H 31/00* (2006.01)
*A61H 23/06* (2006.01)

(52) U.S. Cl.
CPC ..... *A61H 31/005* (2013.01); *A61H 31/007* (2013.01); *A61H 23/06* (2013.01); *A61H 2201/0157* (2013.01); *A61H 2201/0184* (2013.01); *A61H 2201/0188* (2013.01); *A61H 2201/1619* (2013.01); *A61H 2201/501* (2013.01); *A61H 2201/5048* (2013.01); *A61H 2201/5064* (2013.01); *A61H 2201/5071* (2013.01); *A61H 2201/5097* (2013.01)

(58) Field of Classification Search
CPC ... A61H 31/00; A61H 31/005; A61H 31/007; A61H 2201/0184; A61H 2201/1057; A61H 2201/0188; A61H 2201/501; A61H 2201/5048; A61H 2201/5064; A61H 2201/5071; A61H 2201/5097; A61H 2201/1619; A61H 23/06
USPC ..... 601/41–44; 128/898
See application file for complete search history.

(56) References Cited

U.S. PATENT DOCUMENTS

| | | | | |
|---|---|---|---|---|
| 5,454,779 | A | 10/1995 | Lurie | |
| 5,496,257 | A * | 3/1996 | Kelly | 601/41 |
| 5,645,522 | A | 7/1997 | Lurie | |
| 7,361,151 | B2 | 4/2008 | Wood | |
| 2002/0055694 | A1* | 5/2002 | Halperin et al. | 601/41 |
| 2008/0171311 | A1* | 7/2008 | Centen et al. | 601/41 |
| 2011/0201979 | A1* | 8/2011 | Voss et al. | 601/41 |

* cited by examiner

*Primary Examiner* — Quang D Thanh
(74) *Attorney, Agent, or Firm* — David L. King

(57) ABSTRACT

The invention is a manual CPR or CCC continuous chest compression assist device for use on a person suffering cardiac arrest. The assist device has a compressible body structure and an audible signal element, visual signal assembly or both. The audio signal element is interposed in the body structure to announce or generate an audible sound or "click" at a predetermined deflection of the compressible portions. The visual signal assembly is interposed in the body structure to announce or generate a visible light at a predetermined deflection of the compressible portions. The activation of the visual or audio signal corresponds to a predetermined deflection of the compressible portions pressing against the breastbone and alerts the person administering to initiate decompressing to relax the body structure for the next compression, upon relaxation the device decompresses and a second audible or visual signal or both indicates a reset of the device.

25 Claims, 9 Drawing Sheets

MANUAL CPR OR CCC CONTINUOUS CHEST COMPRESSION ASSIST DEVICE

RELATED APPLICATIONS

The present application claims priority to U.S. Provisional Application 61/533,901 filed Sep. 13, 2011 entitled, "Device For Assisting In Manual Cardiopulmonary Resuscitations".

FIELD OF THE INVENTION

The present invention is directed to an improved device to assist in continuous-chest-compression (CCC) to assist in CPR situations involving sudden cardiac arrest (SCA).

BACKGROUND OF THE INVENTION

Historically a cardiac arrest victim was aided by a life-saving procedure called cardiopulmonary resuscitation (CPR) which involved a number of chest compressions interrupted by mouth-to-mouth resuscitation, typically 30 compressions and 2 ventilations. This "pump and blow" procedure was complicated and very fatiguing for the person conducting CPR. Typically classes were provided and CPR certificates of training were given after successful completion of a training course.

The entire CPR procedure was also believed by many to be a dangerous practice due to the possible contraction of aids (HIV) or other diseases attributed to the mouth to mouth contact of saliva from a stranger. These and other concerns greatly reduced the number of people willing to attempt the procedure.

Recent studies have shown that continuous-chest-compression (CCC) by comparison is far more critical than the mouth-to-mouth resuscitation aspect of blowing air into the lungs.

The studies show it is critical to immediately get the blood circulating to have any chance of survival according to the American Heart Association. The survival rates from a cardiac arrest are greatly improved with immediate intervention using chest compressions. This rate of survival falls off dramatically with delay, a stoppage of blood circulation of only a few minutes results in the start of tissue damage. Death is a likely outcome when the blood flow is stopped for over 4-6 minutes, except in extremely cold or freezing situations.

The use of life-saving CPR or CCC is not limited to heart attack victims. Heart pumping and blood flow stoppages occur from electric shock, drowning, choking, suffocation, drug overdose or severe allergic reactions in addition to heart failure.

The American Heart Association estimates 100,000 to 200,000 lives of adults and children in the United States could be saved if timely CPR were performed, more particularly if timely CCC was given to pump blood.

Recently, the Sudden Cardiac Arrest Foundation issued an article entitled "Continuous Chest Compressions Shown To Save More Lives". This article confirms that emphasizing CCC is more beneficial and saves more lives than the old guidelines for CPR. This new guideline still refers to CPR, but in fact CPR is now a Continuous Chest Compression intervention.

A remarkable benefit of the new CPR guidelines is the ability of 9-1-1 emergency dispatchers to remotely coach bystanders over the telephone. The Sudden Cardiac Arrest Foundation published this finding on Jan. 10, 2012. In this article, it points out that people who lack CPR training who were afraid to intervene can be coached over the phone and are able to begin compression about a minute sooner using only CCC. In this situation, one minute sooner could be the difference between surviving and dying. In the article, it is noted breaths are still recommended for all infants and children and adults where asphyxia is the cause. In any situation, however, continuous chest compressions are critical and in almost all other cardiac arrest situations, the only intervention required.

In metropolitan areas, Seattle boasts a 34% survival rate from cardiac arrest. New York City and Chicago have a 4% survival rate. Nationally the survival rate is 14%. This high to low rate is attributable to training, cultural difference and response time required for trained personnel to arrive. Clearly, the goal should strive to be at least as good as Seattle, preferably better with outcomes of 50% or better being reasonable to expect.

Attempts to replace the use of hand delivered chest compression have been attempted; however, such automated devices have proven to be expensive and not as reliable as hand compression. The main problem of using one's hands is the fatigue issue. Providing compressions for a few minutes at high rates can be fatiguing. CPR must be maintained until the patient recovers to consciousness or trained help arrives with defibrillator equipment. This can take well over 10 minutes or more. Without multiple people taking turns, the administrator of CPR will quickly be exhausted and the patient could die.

As these life threatening situations often occur at home, there may only be a spouse or child to assist. In these situations, the problem is very difficult, unless the person providing CPR can be assisted in some safe and reliable fashion. When delivering hand compressions, the hands are placed one over the other and one of the heels of the hand pushes on the chest near the sternum or breastbone to a deflection of about 2 inches (5 cm), this amount of compression yields about 120 psi pressure when measured on CPR mannequin devices. This is repeated at ideally 100-120 beats or continuous compressions per minute. As can be appreciated, this is very demanding. Small children or elderly persons have trouble achieving this and even trained personnel can't do this consistently. Also, adults have been known to crush the chest and break ribs and injure the victim as their adrenaline levels spike during this emergency.

It is an object of the present invention to make continuous chest compressions less fatiguing, more reliable in administering and with self-signaling interactive prompts so even the unskilled person can safely and more effectively deliver CPR with a high level of confidence.

The device as described herein achieves all of these objectives.

SUMMARY OF THE INVENTION

The subject matter of the invention is a manual CPR or CCC continuous chest compression assist device for use on a person suffering cardiac arrest. The assist device has a body structure and an audible signal element or visual signal assembly or both. The compressible body structure has a compressible upper body portion to which a person administering CPR or CCC places his hand to exert a downward force and a bottom compressible portion which is positioned over a breastbone of the person suffering cardiac arrest. The bottom compressible portion is aligned with the upper compressible portion. The audio signal element is interposed in the body structure to announce or generate an audible sound or "click" at a predetermined deflection of the compressible portions. The activation of the audio signal corresponds to a predetermined deflection distance of the compressible portions pressing against the breastbone and alerts the person administering to relax the hands stopping downward force which initiates decompressing the body structure for the next compression. The visual signal assembly is interposed in the body structure to announce or generate a visible light or flash at a predetermined deflection of the compressible portions. The activation of the visual signal corresponds to a predetermined deflection distance of the compressible portions pressing against the breastbone and alerts the person administering to initiate decompressing to relax the body structure for the next compression.

The audio signal element announces a second signal upon relaxation of downward force as the device decompresses to reset the device for the next compression. The compressible body structure moves toward an uncompressed condition as the downward force is removed and the second signal is made to signal a reset. The second audio sound or "click" is an echo or mimics the first sound.

The audio signal element is a domed plate or disk supported on the perimeter by the compressible body structure and with a domed center positioned and suspended in a cavity or hollow to allow the dome to snap as the deflection distance is achieved to annunciate the first signal. The audio signal element has an upper surface and a lower surface and the dome projects outwardly from one of the upper or lower surfaces in a sealed cavity in said body structure and wherein said opposite surface is in a vented cavity. Compression of the body structure increases pressure on the dome causing the dome to snap toward the vented cavity at a predetermined pressure. The predetermined pressure is achieved at the predetermined deflection of the body structure. The dome snaps back toward the sealed cavity as the compressible body is unloaded decompressing causing the internal pressure to lower in the sealed cavity thereby resetting the device for the next compression.

The compressible upper body portion has a cylindrical shape and a hollow central cavity or opening. The compressible upper body portion has a tube shape with the opening extending along a central axis of the tube. The body structure has an end seal affixed to an end of the upper body structure closing the hollow cavity. The hollow cavity of the upper body portion extends between the audio signal element up to a closed sealed end in the upper body portion.

The compressible lower body structure portion has a hollow cavity and a plurality of vent openings extending into the hollow cavity to allow air pressure within the cavity to vent to atmosphere upon compression. The lower body portion is a cylindrical shape wherein the upper body portion and lower body portion are aligned and joined to form the compressible body structure having two compressible portions, the upper and lower body portions. The body structure has an intermediate compressible body structure having a tubular shape positioned between the upper and lower body portions forming the body structure having three compressible portions. The bottom of the lower body portion is a non-slip elastomeric surface. The body structure is made of a compressible elastomer; preferably the body structure is made of a closed cell foam. The preferred elastomeric closed cell foam is a polyethylene foam.

The visual signal assembly is a light assembly that activates a light in response to a compression of the body structure to a predetermined deflection of the compressible portions, wherein the light assembly lights on the downward compression and shuts off when the hands relax to reset the assembly. The visual signal assembly comprises an LED lamp, a switch and one or more batteries. The visual signal assembly further has a housing structure holding the LED lamp, the switch and the batteries in a self-contained light assembly, the light assembly being inserted in a cavity in the body structure. The light assembly lights in synchronization with the activation of the audio signal and shuts off in synchronization with the second audio signal on the relaxation of the compressible body structure to reset the device in one embodiment. The most preferred embodiment is a manual CPR or CCC continuous chest compression assist device for use on a person suffering cardiac arrest. The assist device has a compressible body structure and an audio signal element and a visual signal assembly. The compressible body structure has a compressible upper body portion to which a person administering CPR or CCC places his hand to exert a downward force and a bottom compressible portion which is positioned over a breastbone of the person suffering cardiac arrest. The bottom compressible portion is aligned with the upper compressible portion. The audio signal element and a visual signal assembly are interposed in the body structure to announce or generate an audible sound or "click" and a light or flash at a predetermined deflection of the compressible portions. The activation of the audio and visual signals corresponds to a predetermined deflection distance of the compressible portions pressing against the breastbone and alerts the person administering to relax their hands stopping downward force which initiates decompressing to relax the body structure and resets the device for the next compression. A method of performing CCC continuous chest compressions with a manual CPR or CCC assist device on a person suffering cardiac arrest. The method comprising the steps of positioning the person to be treated on his or her back; taking a CPR or CCC device and placing the device on the chest over the sternum or breastbone, the CPR device having a compressible body structure; placing hands on the top of the device and applying a downward force compressing the device and the chest until a visual signal or audible signal or both occurs; relaxing exerting no downward force as the compressible device and the patient's chest decompresses while listening or observing a second sound occurs or the visual signal shuts off signalling the device is reset; repeating a downward force on the device to accomplish a next chest compression; and repeating the method while being prompted to apply downward force or relaxing by audio signal or visual signal or both emitted from the device. The method further has the steps of continuing chest compression using the assist device as an electric shock from a defibrillator is applied to the patient. The assist device is an electrical insulator.

BRIEF DESCRIPTION OF THE DRAWINGS

The invention is described by way of example and with reference to the accompanying drawings in which.

DETAILED DESCRIPTION OF THE INVENTION

Figure 1:
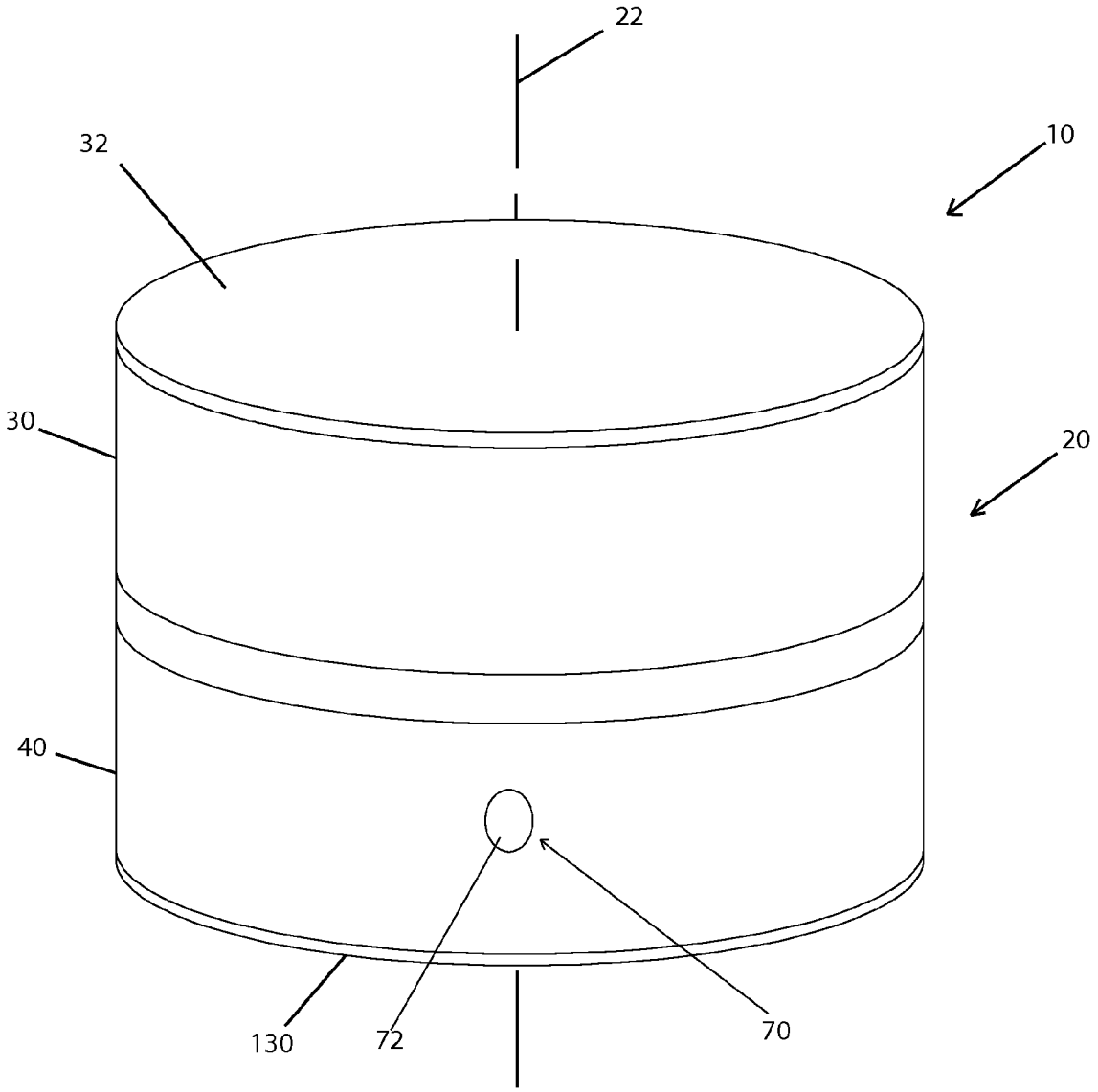
FIG. 1 is a perspective view of the device made in accordance to the present invention according to a first embodiment of the present invention.

Prior to proceeding to the more detailed description of the present invention, it should be noted that, for the sake of clarity and understanding, identical components which have identical functions have been identified with identical reference numerals throughout the several views illustrated in the drawing figures.

Now in reference to FIGS. 1-8, therein is illustrated a device, generally designated as 10, for assisting in manual cardiopulmonary resuscitations (CPR). The device includes a body, generally designated as 20 and manufactured from a compressible material, for example such as foam and, more particularly, polyethylene closed cell foam. The body 20 may be provided as a unitary one-piece body, but preferably, the body 20 includes a compressible first or upper portion, generally designated as 30, for receiving a manual force directly applied thereto by a person performing the CPR. The first or upper portion 30 defines a longitudinal axis 22 of the body 20 and is disposed generally vertically when the device 10 is employed for the assisting in the CPR. There is also a compressible second or lower portion, generally designated as 40, that is aligned axially with the first portion 30 and is disposed in series therewith along the longitudinal axis 22. The bottom axial end 42 of the second portion 40 is sized to fit in abutting engagement within a breastbone area and intermediate a plurality of ribs extending outwardly from opposed side edges of a breastbone of a person receiving such CPR. In use, the second portion 40 transmits the manual force exclusively to such breastbone wherein the transmitted force causes a predetermined movement of such breastbone towards a heart. As shown in FIGS. 1-8, each of the first and second portions, 30 and 40 respectively, has a generally circular peripheral side surface. As shown each first and second portions are cylindrical in shape, preferably tubular cylinders. Alternatively, the portions 30 and 40 could be square, rectangular, or of any column type shape along the exterior surface as long as the shape has an area that fits over the breastbone and facilitates hand compressions. The circular shape satisfies these requirements most efficiently.

A generally closed hollow or cavity chamber 50 is disposed axially in the first portion 30. An aperture or a cavity 60 is disposed axially in the second portion 40. There is vent means, generally designated as 70, for connecting the aperture or cavity 60 in air communication with an external environment. Preferably, such vent means 70 is at least one vent passageway 72 intersecting the cavity 60 and extending through the exterior surface of portion 40. As shown, the passageways 72 are inclined or disposed normal to the longitudinal axis 22. It is understood the vent passageways 72 can be oriented at virtually any inclined angle, with the illustrated normal inclination simply being the shortest path. The device 10 further including an audio signal element or means, generally designated as 8, for annunciating a predetermined compression of the device, 10 that is sufficient to depress rib cage without inflicting damages thereto.

Figure 2:
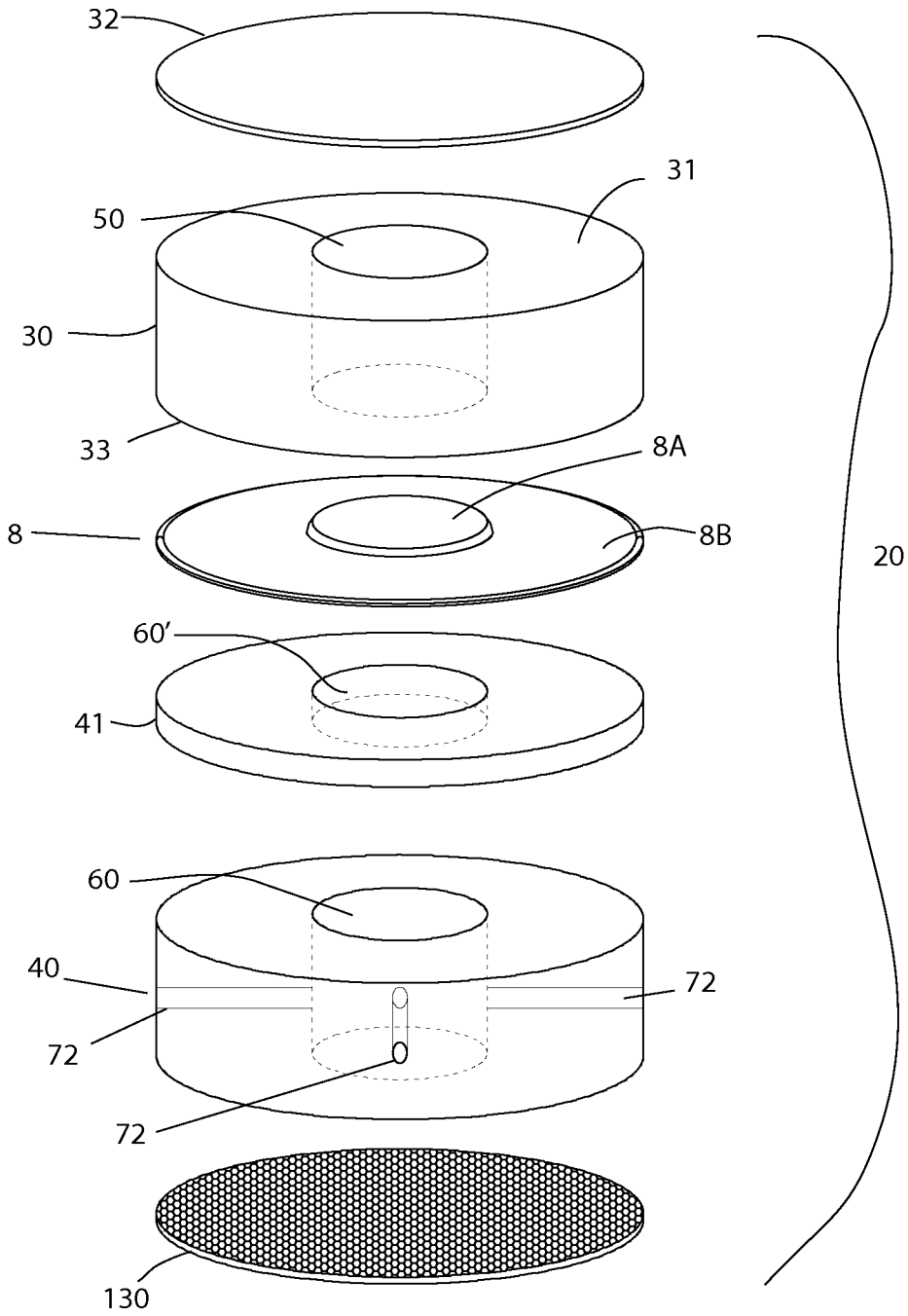
FIG. 2 is an exploded view of the component of the device of FIG. 1.
Figure 5:
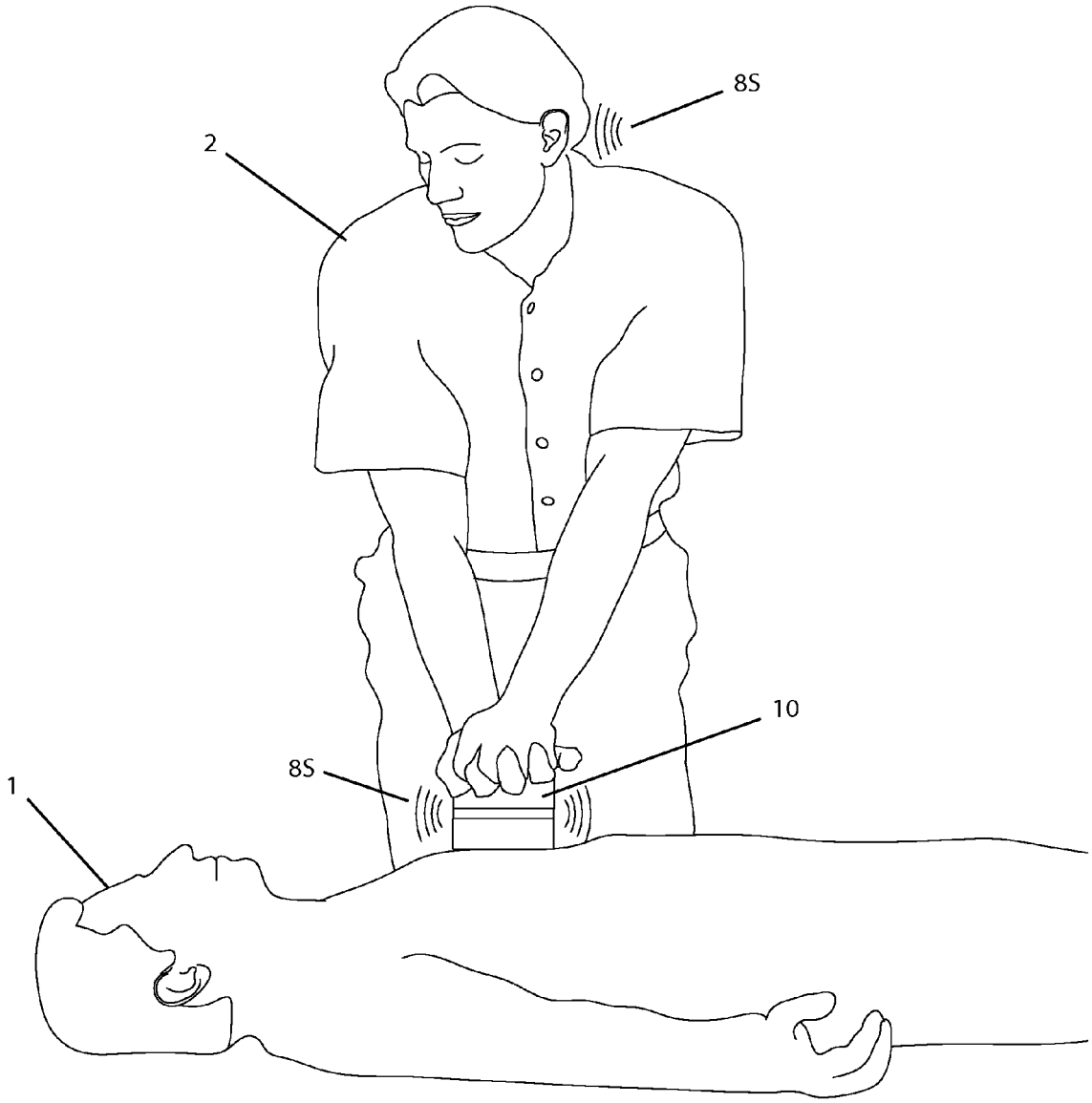
FIG. 5 is a view of the device of the first embodiment with an audio signal shown in use on a person suffering cardiac arrest.

With particular reference to the first embodiment of the invention as shown in FIGS. 1 and 2, an assist device 10 is shown. This device 10 has the compressible body structure 20 formed with three compressible portions, a first or upper portion 30, a second or lower portion 40 and a third middle portion 42 interposed between the two other portions. As shown, each portion 30, 40, 42 is shown as a cylindrical tube or disk having a hollow center. At a top end 31 of the first or upper portion 30 a sealed foam or elastomer end 32 is adhered, preferably adhesively affixed. The combination of the end 32 and upper portion 30 closes the cavity 50. At an opposite end 33 there is placed an audio signal element or means 8. This device on assembly is placed between the compressible first or upper body portion 30 and the third or middle body portion. On assembly, the upper portion 30 is laid with end 33 facing upwardly and the audio signal element 8 is centered on the end and has a diameter slightly smaller than the compressible body portions 30, 42 such that a bead of adhesive when placed on the perimeter of the first or upper portion 30 at end 33 the audio signal element is spaced from the adhesive and the outer perimeter of the adjoining intermediate portion 42 adheres to the bead of adhesive allowing the audio signal element to float being held in place sandwiched between the two portions 30, 42. At this point in the assembly, the hollow cavity or chamber 50 is sealed or closed such that when the first or upper portion is compressed a pressure build up occurs in the chamber. This raised pressure feature allows the audio signal element 8 to deflect at the raised dome portion causing an audible snap or "click". The opposite side of the signal element 8 faces an open cavity 60, 60' which is vented to the atmosphere so as the body 20 of the device 10 compresses air pressure in the sealed cavity 50 rises and the unsupported center of the dome deflects creating a first audible sound or click 8S as shown in FIG. 5. This first sound 8S occurs at a predetermined deflection of the chest of about 2 inches which reflects or indicates a predetermined pressure in the chest approaches 100 psi or slightly greater and the person applying downward pressure will cause about a 2 inch deflection on the chest. Due to the reaction time for the person 2 to hear the sound 8S and stop downward force, the lag time of a small fraction of a second causes the pressure to spike at approximately 120 psi at the desired 2 inches of chest compression. The compression on the body structure causes the device to deflect lower in height. This deflection occurs at a predetermined distance or deflection of a lesser amount than the chest dependent on the density of the compressible body portions. As the body portion is flattened under downward force the sealed cavity pressure rises. This deflection of the body structure is less than 2 inches, typically about 0.5 inches to about 1 inch when the unloaded device 10 is at or over 3 inches tall. This deflection of the body structure 20 is also at a distance predetermined to achieve the desired 2 inch chest compression and to match the signal element activation pressure.

This compression of the body structure stops when the hands relax and the downward force ceases and the compressible portions 30, 40 and 42 recover like a spring, decompressing and returning to close to the starting or reset height of the body 20. Most importantly, as the body structure resets the pressure inside the sealed cavity 50 drops back to ambient and the deflected dome snaps back causing a second sound or "click" signifying the device 10 is reset and ready for the next chest compression. In this use of an audible sound 8S, the person performing CPR is alerted when a desired predetermined pressure is achieved in the chest cavity as evidenced by the 2 inch deflection of the chest. The sound 8S annunciates and effectively confirms this has occurred. Testing of the device on a medical mannequin hooked to a light sensor indicator and a pressure gauge confirms the click sound and end of stroke compression by the user 2 nicely coincides with 120 psi and this occurrence can be repeatedly maintained at 100 to over 120 beats or compressions per minute. As one will appreciate, this means each entire compression cycle occurs within 0.5 seconds. Accordingly, the device's 10 ability to spring back and reset during relaxation is very fast measuring in tenths of a second. The reset causes a second audible signal 8S prompting the user to start the next compression. The device basically teaches the user to press, relax, press, relax on each set of sounds 8S. The device 10 upon achieving this first sound signal has been tested to confirm adequate chest deflection and therefore pressure has been delivered. This provides added confidence to the user.

With further reference to FIGS. 3A-3F, each of the components shown in FIG. 2 are illustrated in a top view to better appreciate the device's 10 beautiful simplicity of design.

Figure 3A:
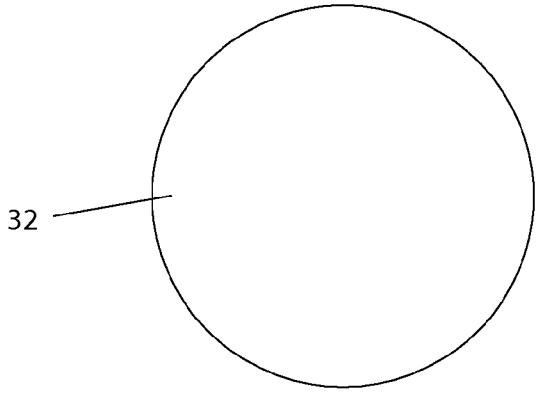
FIG. 3A is a top view of a top seal.
Figure 3B:
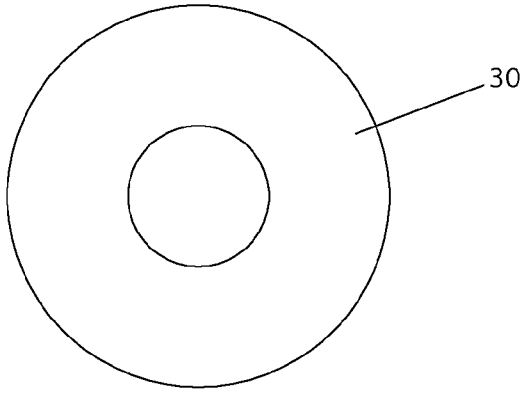
FIG. 3B is a top view of an upper compressible section.

In FIG. 3A, the seal end 32 is shown. The end 32 is made preferably of an elastomer or rubber that is basically air impermeable to seal the cavity 50 when affixed to the first or upper body structure 30. All the compressible body portions; upper 30, lower 40 and middle 42 if used, can be made of the same material at the same density. Alternatively, the materials can be different as can the densities. In any construction, the device 10 when assembled needs to confirm that the audio signal or light signal or both must trigger to reflect and annunciate that the proper predetermined deflection of the chest cavity has been met. This means any device 10 will compress a distance equal to an amount commensurate with the material chosen. The inventor has selected a closed cell polyethylene foam and has achieved the desired results, other materials can be used at the discretion of the manufacturer as long as these conditions are met.

Figure 3C:
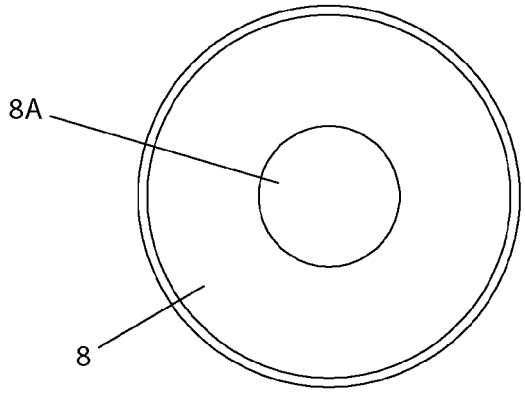
FIG. 3C is a top view of a sound or audio signal element.
Figure 3D:
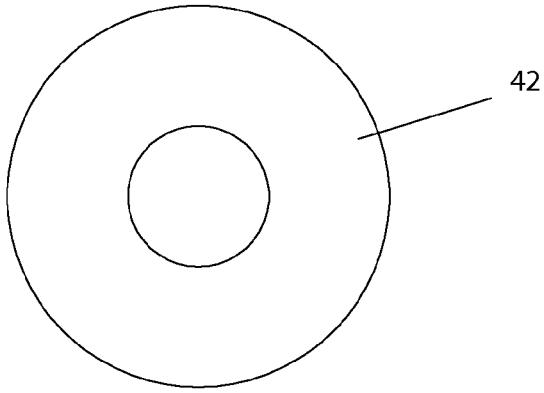
FIG. 3D is a view of a middle compressible section.
Figure 3E:
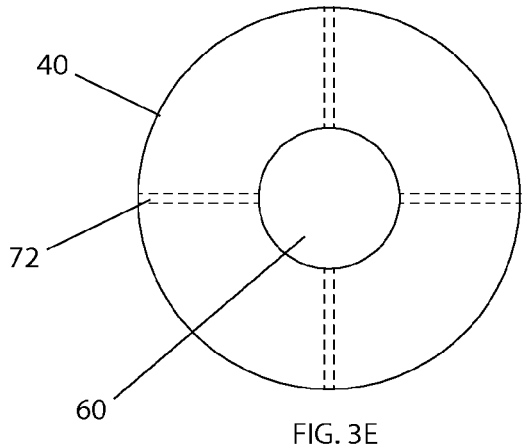
FIG. 3E is a view of a bottom compressible section.

With reference to FIGS. 2 and 3C, the audio signal element 8 is shown. The center dome 8A projects outwardly from the flat plate or disk portion 8B. As shown, this device 8 is made of a thin metal material such as tin or steel which is preferably plated or coated to prevent rusting or could alternatively be made of a hard plastic material. When assembled, pressure on the element 8 surface facing the sealed cavity 50 causes the dome 8A to deflect making an audible sound. Once the pressure is removed, the dome 8A snaps back. The present invention audio signal element 8 must make the first sound 8S and reset second sound 8S in fractions of a second for ten minutes or longer resulting in over a thousand cycles. This feature requires the element 8 to be both flexible and fatigue resistant.

Figure 3F:
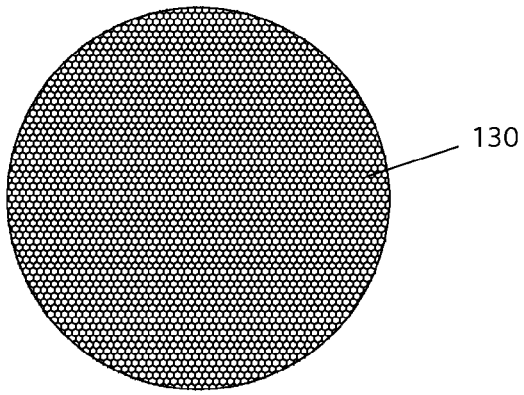
FIG. 3F is a view of a bottom no-slip element.

In FIG. 3F, the bottom non-slip end 130 is preferably made of an elastomeric material adhesively adhered to the end of the lower body portion 40. As shown, the end 130 can be made with openings or like a soft net-like material. This allows the bottom to breathe and forms ridges to grip the skin or slick shirt or blouse helping to position the device 10 on the chest area without sliding or slipping.

Importantly, unlike manual hand CPR, the arrest patient can be lying on a sofa, a recliner or in bed and the device 10 will function delivering proper chest compression regardless of the surface. Normally, the manual unassisted CPR giver must first lay the victim on a hard flat surface. Remarkably, the device 10 will work as long as the device can see enough resistance to deflect to trigger the sound element 8. This has been confirmed in testing. This feature saves time.

A second important feature is a person under cardiac arrest can be fully clothed at the chest region and CPR can be initiated without wasting time exposing the chest. The device works well through shirts, blouses, bras, sweaters. Often untrained persons are reluctant to remove clothing exposing a person's breast to conduct CPR or CCC. The present device avoids this time consuming procedure allowing CPR/CCC to be started immediately.

Figure 8:
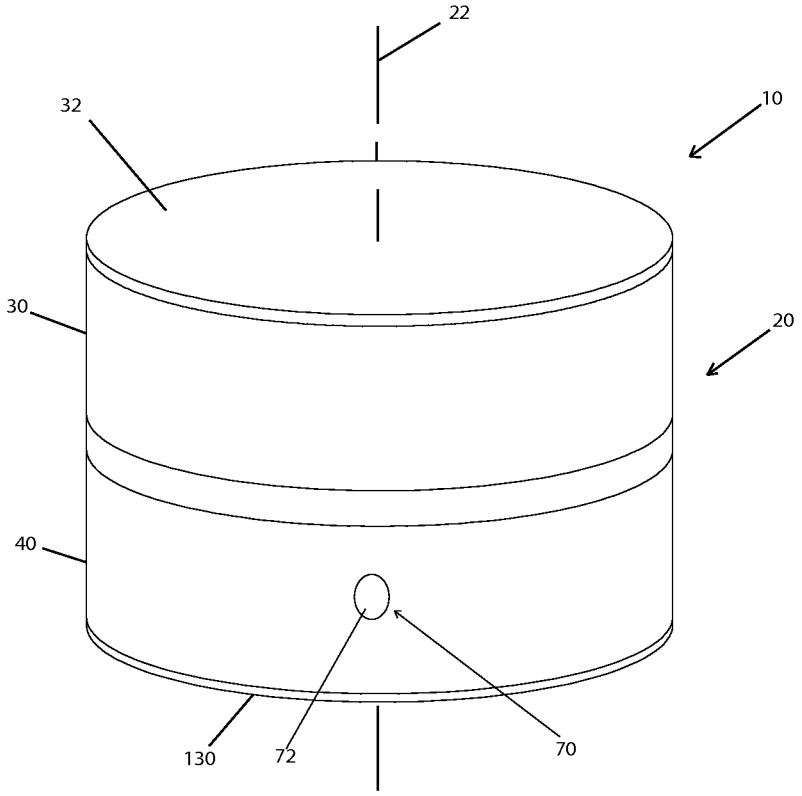
FIG. 8 is an alternative device, but made with an upper top section and lower compressible section without a middle section.
Figure 9:
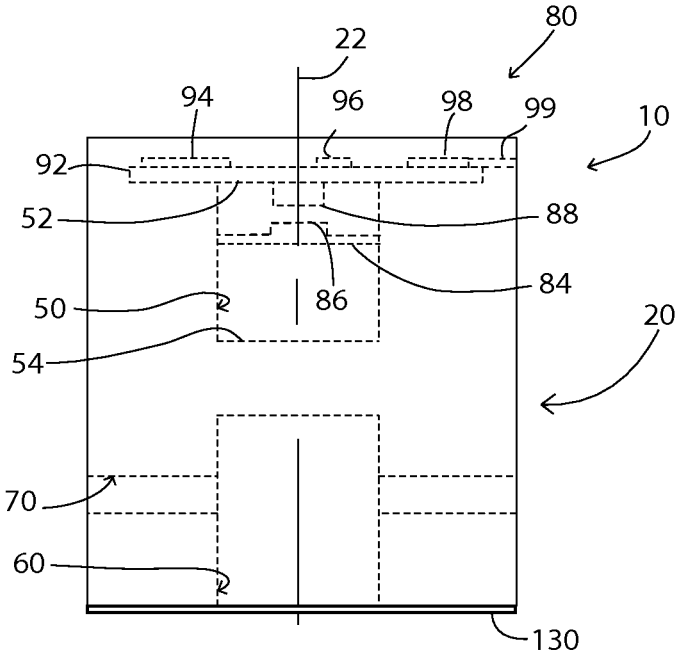
FIG. 9 is another elevation view of a device for assisting in manual cardiopulmonary resuscitations.
Figure 10:
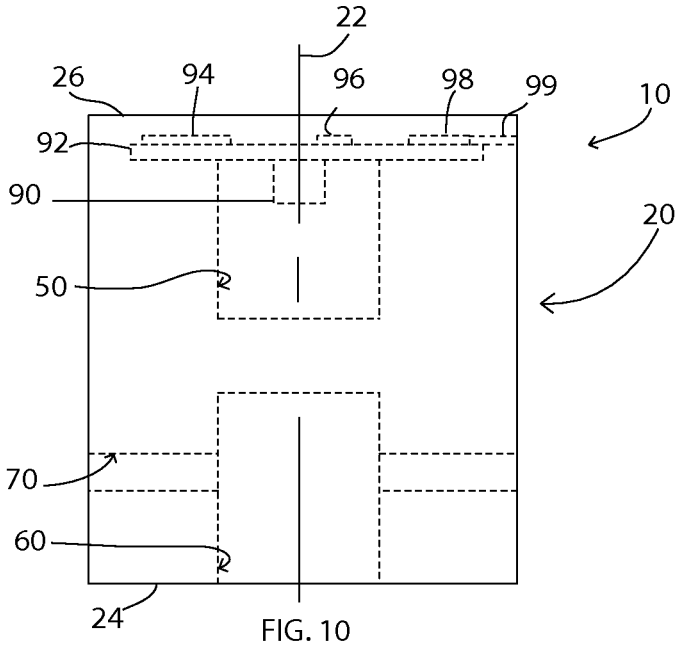
FIG. 10 is yet another elevation view of a device for assisting in manual cardiopulmonary resuscitations.
Figure 11:
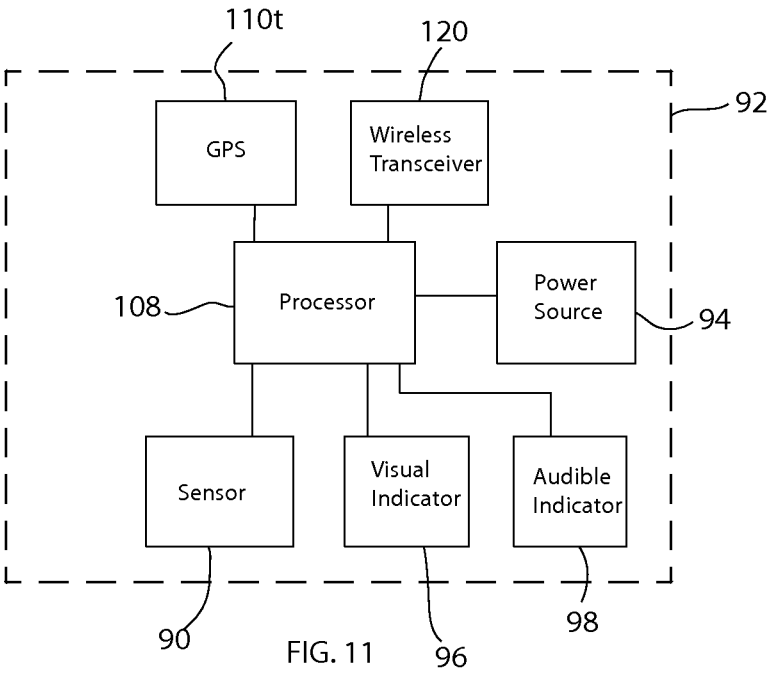
FIG. 11 is a block diagram of the device of FIGS. 9 and 10.

In FIG. 8, the device 10 is further simplified in an alternative third embodiment shown with every element except the intermediate middle portion 42. In this alternative, the compressible body portion 20 has the first or upper portion 30 directly joined to the lower portion 40. As a two compressible portion body structure 20. Otherwise this alternative 10 of FIG. 8 is identical in structure and performance as FIGS. 1-5.

Figure 4A:
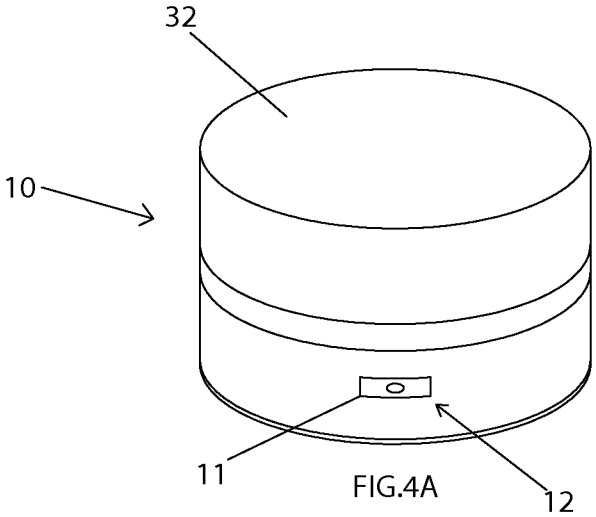
FIG. 4A is a second embodiment perspective view of the present invention with a visual or light signal element and audio or sound element.
Figure 4B:
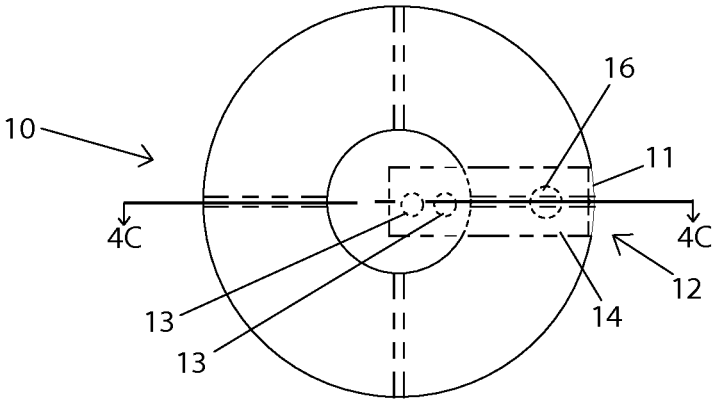
FIG. 4B is a top view of the second embodiment shown in 4A.
Figure 4C:
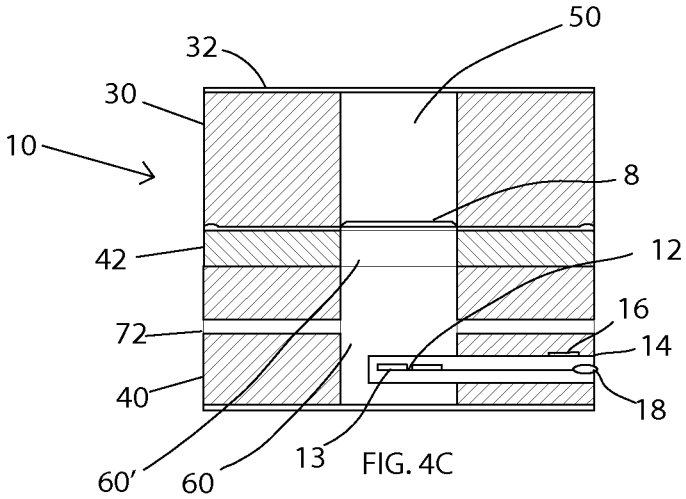
FIG. 4C is a cross sectional view taken along lines 4C-4C of FIG. 4B.
Figure 6:
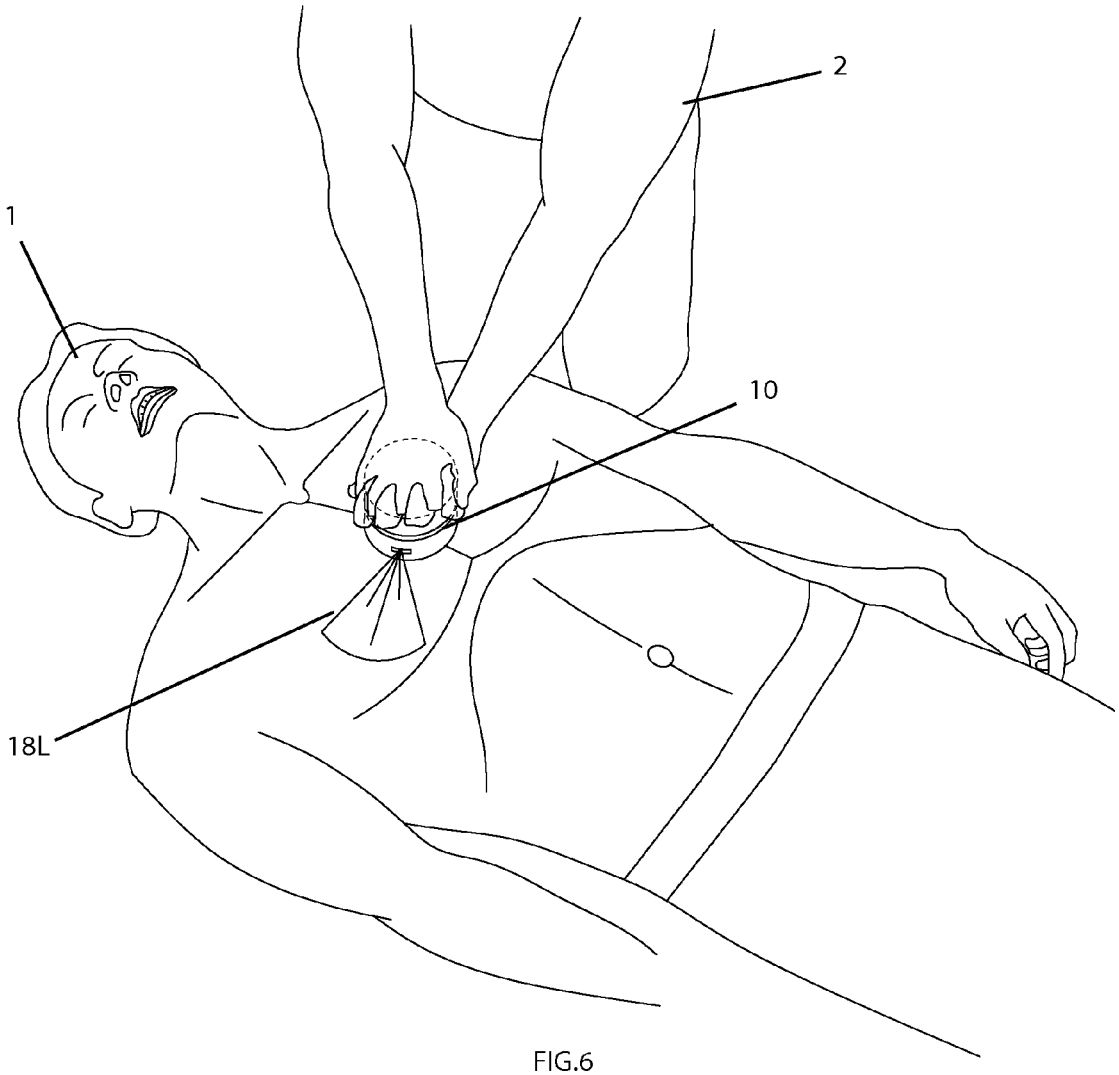
FIG. 6 is a view of the device made as a third embodiment having only a visual or light signal.

With reference to FIGS. 4A, 4B and 4C, a second visual signal feature of the device 10 is provided. The added feature can be provided to work with the audio signal element 8 in a single device 10 as illustrated, or can replace the audio signal element or means 8 completely as best illustrated in FIG. 6.

As shown in FIG. 4A, a cavity or opening 11 is provided into which a visual signal assembly 12 is inserted. The visual signal assembly 12 has a housing 14 inside of which is one or more batteries 13, of the kind commonly found in watches. The batteries 13 are housed in housing 14 and connected to an on/off switch 16 which when depressed connects the batteries to an LED light or lamp 18 which illuminates only when the switch 16 is depressed. Accordingly, the lamp assembly 12 flashes a beam of light 18L onto the area above the patient's chest at the precise timing of the signaling for end of compression of the body structure 20. The cavity 11 closes about the lamp assembly 12 and presses the switch 16 on. At this point of deflection, the device 10 corresponds nicely with the 2 inch chest compression on the person 1 receiving CPR. That 2 inches of deflection achieves 120 psi of measured pressure on a test gauge hooked to a CPR mannequin and is a confirmation of good compression.

The person 2 applying CPR with the device 10 sees the light beam 18L and stops the downward force relaxes his or her hands as the compressible body 20 having the compressible portions 30, 40 and optional intermediate portion 42 if used, recover springing back toward the devices decompressed original height. As soon as the device 10 is unloaded and recovers, the switch 16 also returns shutting off the lamp 18. The lamp 18 going off is a second visual signal that the device is reset to repeat the next compression.

The use of the light assembly 12 alone is ideal in situations where the audio signal 8S is undesirable or clearly not audible due to extreme background noise.

Figure 7:
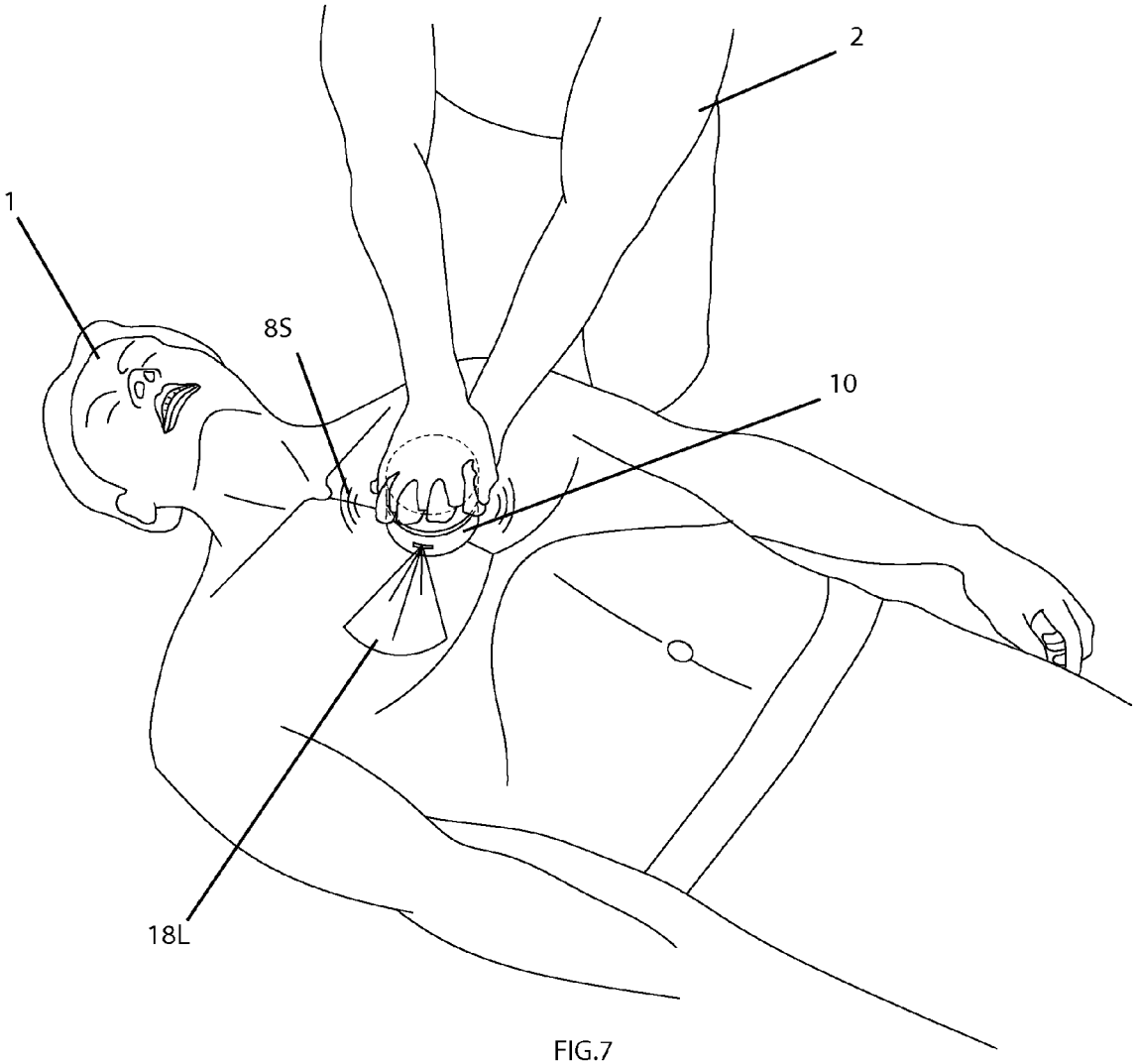
FIG. 7 is a view of the preferred second embodiment device in use having both audio and visual signal features.

Most preferably, the best mode of practicing the present invention is shown in FIG. 7 wherein the device 10 provides both audio and visual signals. Most preferably, signals first annunciating the end of compression and second signals annunciating reset of the device for the next compression.

As shown, the device 10 in every embodiment has an uncompressed height of 3 inches (76.2 mm) or more and when configured as a cylinder has a diameter of about 3.5 inches (88.9 mm). At the top of the device 10 the spanned area for the hand to press is about 9.6 square inches. Similarly, the spanned area for the chest contacting compression is 9.6 square inches, it being understood the column shape in the center is a cavity or void thus effectively lowering the center pressure, but as can be appreciated, the tubular wall thickness of the column of the body portion 40 moves the entire underlying breastbone regardless of the concavity at the center. It is believed the height of the device 10 ensures the fingers can wrap around or hang suspended from the top without contacting the person 1 receiving CPR. This elevated support of the hands focuses the downward force making it much easier and less fatiguing. The device 10 insures the user does not over exert himself as a result elderly and young children can properly administer CPR for times of 10 to 12 minutes or more without being completely exhausted. This allows sufficient time to get first responders on site to help. Without the assist device, these elderly and young simply cannot provide CPR reliably in terms of chest deflection and pace and as a result survival chances are diminished. Even trained professionals find the assist gives them longer staying power and confidence that each compression made is optimized to avoid over exertion. Naturally, injury by untrained CPR givers is virtually eliminated as the device 10 not only insures proper compressions, it also acts as a shield by damping the hand impact through the compressible foam structure. This means eliminating CPR related injuries like broken ribs.

In accordance with one form of the invention, annunciating means 80 includes a membrane 84 disposed at end 52 of the generally closed chamber 50 being opposite from end 54 disposed adjacent inner or proximal end 32 of the first portion 30. The membrane 84 is mounted for axial movement toward the end 52 of the generally closed chamber 50 during compression of the first portion 30. A movable contact member 86 is disposed on the membrane 84 and is capable transferring electric energy. There is also a stationary sec contact member 88 that is axially aligned with the move contact member 86. In operation, as the device 10 is being compressed, pressure is increasing within the closed chamber proportional to the compression distance. As the pressure increases, membrane 84 moves toward the stationary contact and urges or biases the movable contact 86 to directly contact the stationary contact 88 when the pressure reaches predetermined value.

In accordance with another form of the invention, annunciating means 80 includes a pressure switch 90 that positioned in communication with the closed chamber 50 adjacent the end 52 thereof and that is responsive to increase of pressure in the closed chamber 90 to generate electric signal indicative of the pressure reaching the predetermined value.

Preferably, either stationary contact 88 or the pressure switch 90 is disposed on attached to a printed circuit board (PCB) 92. In such embodiment, the pressure switch 90 may be of PX70 series type as available from OMEGA, Inc. of Stamford, Conn. or model 50 as manufactured by Measurement Specialties of Fremont, Calif.

In either form, the annunciating means 80 further includes a source 94 of the electric energy that is disposed in the first portion 30, in electric communication with the movable contact Member 86. Preferably, the source 94, being at least one conventional battery, is also being mounted on the PCB 92.

It is contemplated for the annunciating means 80 to include at least one visual indicator, such as light emitting device 96, that is mounted in electrical communication with the stationary contact member 88, wherein contact between the contacts 86 and 88 causes the electric energy from the source 94 to energize the least one light emitting device 96 and emit a light visible by a user of the device 10.

In addition to or independently from the at least one light emitting device 96, the annunciating means 80 may include at least one audible indicator, such as a sound emitting device 98, that is energized upon contact between contacts 86 and 88, wherein the sound is received by the user of the device 10. Accordingly, the body 20 may be provided with at least one sound port 99.

In yet another form of the invention, the annunciating means 80 provided as a generally thin member 100 disposed between the first and second portions, 30 and 40 respectively, and having a curved portion 102 sized to fit within each of the chamber 50 and the aperture or cavity 60 disposed axially in the second portion 40. The curved portion 102 is adapted for axial movement, due to pressure, between a first position extending slightly into the chamber 50 disposed axially in the first portion 30 during normal condition of the device 10 and a second position extending into the aperture or cavity 60 disposed axially in the second portion 40 during application of the manual force and a "click" sound generated by the axial movement of the curved portion 102 at least from the first position into the second position. It would be appreciated that the generally thin member 100 may be provided in an addition to the previously described embodiments of the annunciating means 80.

The device 10 may further include optional processor 108 and means 110 for transmitting absolute geographical position of the device. Such means 110 is provided by a conventional Global Positioning Systems (GPS) technology. Such means 110 is preferably mounted on the PCB 92 and is activated upon first contact between the movable contact member 86 with the stationary contact member 88. Operation of the means 110 either continues for entire duration of use of the device 10 or terminates after a preselected period of time, either during or after use of the device 10.

Thus, the instant invention provides a method of annunciating location of a person receiving manual cardiopulmonary resuscitations (CPR). The method includes the step of providing the above described device 10 having a compressible body 20 defining a longitudinal axis 22 of the device 10 and having a pair of axial ends 24, 26 spaced apart from each other to define length of the device 10, wherein one of the pair of axial ends is sized for direct abutment with one of a skin and clothing of a person receiving the CPR, a closed chamber 50 disposed axially in close proximity to an opposite one of the pair of axial ends, the opposite one of the pair of axial ends receiving a manual force directly applied thereto by a person performing the CPR, an aperture or a cavity 60 disposed axially in the compressible body 20 in close proximity to the one of the pair of axial ends, means 70 for communicating the aperture or cavity 60 to an external environment of the device, and a GPS member 110 disposed within the device and responsive to change of pressure in the closed chamber to transmit location of the device. Next, positioning one end of the device 10 in direct contact with one of a skin and clothing of the person receiving the CPR.

Then, applying a force axially to the opposite one of the pair of axial ends of the device 10. Increasing pressure, with a continuing application of the force, in the closed chamber 50 to a predetermined value. Finally, generating, with the GPS member 110, in response to the predetermined pressure, a signal indicative of absolute location of the person receiving the CPR. The device 10 may also include a transceiver circuitry 120 for generating a wireless transmission to an emergency response network. For example the circuitry 120 may be adapted to generate a call to 911 number and may further provide a voice communication capability so that person performing CPR can directly communicate with emergency response operator and/or medical personnel. Furthermore, if needed, the operator can provide instructions on how to perform CPR using the device 10 as well as monitor the compressions by hearing "click" or audible annunciation every time the compression is completed.

The device 10 may also include at least one non-slip means 130 disposed on the axial end of the body 20 for at least substantially minimizing slippage of the device 10 placed onto a skin or closing of a person receiving CPR or slippage to the person performing CPR.

In each of these embodiments the preferred device 10 was made of a cellular foam and assembled. Alternatively, the entire device could be molded using expandable foam as a single body structure 20. The advantage of molding the body structure allows the exterior surface to have an outer flexible skin or simulated leather look. These materials can have the electronic devices or the light assembly installed later or insert molded into the device. This molding is well known in the automotive art and used in steering wheel assemblies. In any device the exterior surface must be flexible to allow compression of the body structure.

While the present invention used the terms upper or lower when referring to the body structures 30, 40 it is important to note the device 10 was designed with a preferred orientation so the non-slip end 130 was on the chest and the sealed cavity 50 at the top near the hands. Interestingly, during testing the device 10 was inverted or used with the sealed end 32 on the chest and the CPR and CCC chest compressions along with the audio signal and light assembly worked exactly as required with no apparent loss of function. While this seems trivial, in an emergency situation it is ideal that the user 2 given two options of orientation cannot make a mistake. In this high stress situation, the person 1 under a cardiac arrest life depends on proper CPR delivery and the device 10 as described above provides this even if used upside down.

Variations in the present invention are possible in light of the description of it are provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described, which will be within the full intended scope of the invention as defined by the following appended claims.

What is claimed is:

1. A manual CPR or CCC continuous chest compression assist device for use on a person suffering cardiac arrest, the assist device comprises:

a compressible body structure having a compressible upper body portion to which a person administering CPR or CCC places his hand to exert a downward force and a bottom compressible portion which is positioned over a breastbone of the person suffering cardiac arrest, the bottom compressible portion being aligned with the upper compressible portion;

an audio signal element is interposed in the body structure to announce or generate an audible sound or "click" at a predetermined deflection distance of the compressible portions wherein the audio signal element is a domed plate or disk supported on the perimeter by the compressible body structure and with a center dome positioned and suspended in a cavity or hollow to allow the dome to snap as the deflection distance is achieved to annunciate a first signal;

wherein an activation of the audio signal element corresponds to the predetermined deflection distance of the compressible portions pressing against the breastbone and alerts the person administering to initiate decompressing to relax the body structure for the next compression; and wherein the audio signal element announces a first audible sound or "click" as the first signal at the predetermined deflection distance during a compression and upon relaxation of downward force the audio signal element is reset and the device is ready for the next compression and as the compressible body structure moves toward an uncompressed condition as the downward force is removed and a second audible sound or "click" occurs as a second signal is made to signal a reset of the device, wherein the first signal and the second signal repeat on each successive compression and decompression to the predetermined deflection distance.

2. The manual CPR or CCC continuous chest compression assist device of claim 1 wherein the second audible sound or "click" is the same or similar to the first audible sound or click.

3. The manual CPR or CCC continuous chest compression assist device of claim 1 wherein the audio signal element has an upper surface and a lower surface and the dome projects outwardly from one of the upper or lower surfaces in a sealed cavity in said body structure and wherein said opposite surface is in a vented cavity.

4. The manual CPR or CCC continuous chest compression assist device of claim 3 wherein compression of the body structure increases pressure on the dome causing the dome to snap toward the vented cavity at a predetermined pressure.

5. The manual CPR or CCC continuous chest compression assist device of claim 4 wherein the predetermined pressure is achieved at the predetermined deflection distance of the body structure.

6. The manual CPR or CCC continuous chest compression assist device of claim 4 wherein the dome snaps back toward the sealed cavity as the compressible body is unloaded decompressing therefore resetting for the next compression.

7. The manual CPR or CCC continuous chest compression assist device of claim 1 wherein the compressible upper body portion has a cylindrical shape and a hollow central cavity or opening.

8. The manual CPR or CCC continuous chest compression assist device of claim 1 wherein the compressible upper body portion has a tube shape with the opening extending along a central axis of the tube.

9. The manual CPR or CCC continuous chest compression assist device of claim 7 wherein the body structure has an end seal affixed to an end of the compressible upper body portion closing the hollow cavity.

10. The manual CPR or CCC continuous chest compression assist device of claim 7 wherein the hollow cavity of the compressible upper body portion extends to a closed sealed end in the upper body portion.

11. The manual CPR or CCC continuous chest compression assist device of claim 1 wherein the bottom compressible portion has a hollow cavity and a plurality of vent openings extending into the hollow cavity to allow air pressure within the cavity to vent to atmosphere upon compression.

12. The manual CPR or CCC continuous chest compression assist device of claim 7 wherein the bottom compressible portion is a cylindrical shape wherein the compressible upper body portion and the bottom compressible portion are aligned and joined to form the compressible body structure having two compressible portions, the compressible upper body portion and the bottom compressible portion.

13. The manual CPR or CCC continuous chest compression assist device of claim 12 wherein the body structure has an intermediate compressible body structure having a tubular shape positioned between the compressible upper body portion and the bottom compressible portion forming the body structure having three compressible portions.

14. The manual CPR or CCC continuous chest compression assist device of claim 1 wherein an end of the bottom compressible portion is a non-slip elastomeric surface.

15. The manual CPR or CCC continuous chest compression assist device of claim 1 wherein the body structure is made of a compressible elastomer.

16. The manual CPR or CCC continuous chest compression assist device of claim 15 wherein the body structure is made of a closed cell foam.

17. The manual CPR or CCC continuous chest compression assist device of claim 16 wherein the elastomeric closed cell foam is a polyethylene foam.

18. The manual CPR or CCC continuous chest compression assist device of claim 1 further comprises:

a visual signal assembly, the visual signal assembly is a light assembly inside the body structure that activates a light in response to a compression of the body structure to the predetermined deflection distance of the compressible portions.

19. The manual CPR or CCC continuous chest compression assist device of claim 18 wherein the light assembly lights on a downward compression force to the body structure to the predetermined deflection distance and shuts off on decompression to reset the light assembly.

20. The manual CPR or CCC continuous chest compression assist device of claim 19 wherein the visual signal assembly comprises an LED lamp, a switch and one or more batteries.

21. The manual CPR or CCC continuous chest compression assist device of claim 20 wherein the visual signal assembly further comprises:

a housing structure holding the LED lamp, the switch and the batteries in a self-contained light assembly, the light assembly being inserted in a cavity in the body structure.

22. The manual CPR or CCC continuous chest compression assist device of claim 21 wherein the light assembly has the LED lamp lights in synchronization with an activation of the first signal during the compression to the predetermined deflection distance and the LED lamp shuts off in synchronization with the second signal on the relaxation of the downward force of the compressible body structure to reset the device.

23. A manual CPR or CCC continuous chest compression assist device for use on a person suffering cardiac arrest, the assist device comprises:

a compressible body structure having a compressible upper body portion to which a person administering CPR or CCC places his hand to exert a downward force and a bottom compressible portion which is positioned over a breastbone of the person suffering cardiac arrest, the bottom compressible portion being aligned with the compressible upper body portion;

an audio signal element and a visual signal assembly are interposed in the body structure to announce or generate an audible sound or "click" and a light or flash at a predetermined deflection distance of the compressible portions wherein the audio signal element is a domed plate or disk supported on the perimeter by the compressible body structure and with a center dome positioned and suspended in a cavity or hollow to allow the dome to snap as the deflection distance is achieved to annunciate a first signal;

wherein an activation of the audio signal element and the visual signal assembly corresponds to a predetermined deflection distance of the compressible portions pressing against the breastbone and alerts the person administering to initiate decompressing to relax the body structure for the next compression; and wherein the audio signal element announces a first audible sound or "click" as the first signal and at the predetermined deflection distance during a compression and upon relaxation of downward force the audio signal element is reset and the device is ready for the next compression and as the compressible body structure moves toward an uncompressed condition as the downward force is removed and a second audible sound or "click" occurs as a second signal is made to signal a reset of the device, wherein the first signal and the second signal repeat on each successive compression and decompression to the predetermined deflection distance.

24. A method of performing CCC continuous chest compressions with a manual CPR or CCC assist device on a person suffering cardiac arrest, the method comprising:

positioning the person to be treated on his or her back;

taking a CPR or CCC device and placing the device on the chest over the sternum or breastbone, the CPR device having a compressible body structure;

placing hands on the top of the device and applying a downward force compressing the device and the chest until a visual signal and audible signal are emitted from the compressible body structure;

relaxing exerting no downward force as the compressible device and the patient's chest decompresses while listening or observing a second sound occurs or the visual signal shuts off signaling the device is reset;

repeating a downward force on the device to accomplish a next chest compression; and repeating the method while being prompted to apply downward force or relaxing by the audible signal or the visual signal or both emitted from the device.

25. The method of claim 24 further comprises the steps of:

continuing chest compression using the assist device the assist device being an electrical insulator between the person administering and the person receiving the CPR or CCC.

* * * * *